United States Patent [19]

Tedder

[11] 4,122,776

[45] Oct. 31, 1978

[54] DYNAMIC CLAMP CIRCUITS

[75] Inventor: Paul M. Tedder, Gainesville, Fla.

[73] Assignee: The United States of America as represented by the Secretary of the Army, Washington, D.C.

[21] Appl. No.: 454,237

[22] Filed: Sep. 3, 1954

[51] Int. Cl.[2] ..... F42B 5/08; F42B 9/08; F42B 21/38

[52] U.S. Cl. ..... 102/214; 343/7 PF; 328/115; 328/165

[58] Field of Search ..... 343/5, 7, 7 PF; 102/70.2, 70.2 P; 250/27 PD, 20.5 P, 20.282, 6.45, 27 PS, 27 N, 20.53; 129/171-179 G

[56] References Cited

U.S. PATENT DOCUMENTS

| | | | |
|---|---|---|---|
| 1,483,172 | 2/1924 | Gannett | 328/162 |
| 2,390,502 | 12/1945 | Atkins | 328/171 |
| 2,420,518 | 5/1947 | Brown | 325/348 |
| 2,441,030 | 5/1948 | Page | 102/207 |
| 2,496,909 | 2/1950 | Eberhard | 328/117 |
| 2,683,806 | 7/1954 | Moody | 328/115 |

FOREIGN PATENT DOCUMENTS 619,523 3/1949 United Kingdom.

*Primary Examiner*—S. C. Buczinski
*Attorney, Agent, or Firm*—Nathan Edelberg; Robert P. Gibson; Saul Elbaum

EXEMPLARY CLAIM

1. An electronic ordnance fuze adapted to function upon receiving a target signal that increases in amplitude for at least a predetermined length of time, said fuze comprising: input means adapted to receive an alternating-current signal of increasing amplitude; first means for obtaining from said alternating-current signal a first negative-going unipotential signal of increasing amplitude, a ripple frequency due to the original alternating current being superimposed on said unipotential signal; an amplifier tube having at least a control grid, a screen grid, and an anode; means for applying said negative-going unipotential signal to said control grid; sources of direct current supply voltage for said screen grid and said anode, the voltage at the screen grid being maintained more positive than the voltage at the anode and the operating conditions being so maintained that the anode current remains substantially saturated for control grid signals more positive than a predetermined negative value; means for taking an amplified unipotential signal from said screen grid, said screen grid thus resembling functionally the plate of a triode amplifier; first and second capacitor means for coupling said ripple frequency present in said first negative-going unipotential signal to said screen grid and to said anode, said capacitor means tending to filter out said ripple, the degree of filtering being dependent upon the gain of said amplifier tube; means for obtaining a direct-current feedback voltage from said anode; a biased diode; means for applying said feedback voltage to said control grid through said biased diode, so that, if said alternating-current signal is of sufficient amplitude and increases in amplitude at an abnormally large rate, a direct-coupled inverse feedback voltage is applied to said control grid, reducing the gain of said amplifier but permitting the ripple-frequency output of said amplifier to increase; resistance-capacitance differentiator means adapted to produce a unipotential output signal upon receiving a positive-going unipotential signal from said screen grid of said amplifier; diode rectifier-limiter means connected between the output of said differentiator means and ground, said rectifier-limiter means serving to prevent the output of said differentiator means from rising appreciably above ground potential and serving also to rectify any component of said ripple frequency present in the input of said differentiator means, so as to make the output of said differentiator means more negative when the ripple-frequency output of said amplifier increases; resistance-capacitance integrator means connected to the output of said differentiator means; a thyratron; means for applying to the grid of said thyratron a signal from the output of said integrator means; and fixed bias means for maintaining the output of said differentiator and the grid of said thyratron at values sufficiently negative to prevent firing of said thyratron in the absence of a signal.

2 Claims, 1 Drawing Figure

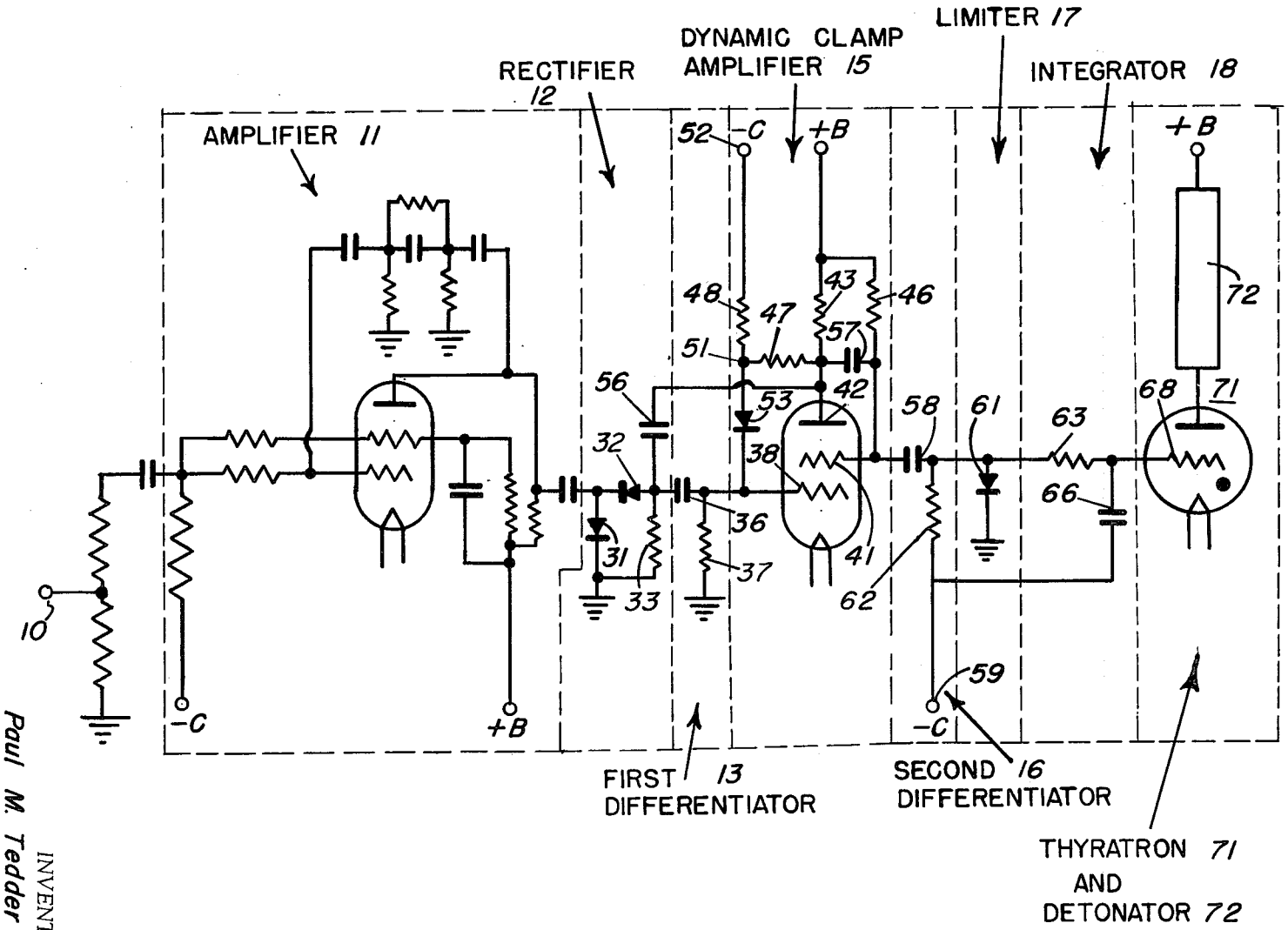
INVENTOR
Paul M. Tedder
BY W. E. Thibodeau, A. W. Dew and J. D. Edgerton ATTORNEYS

DYNAMIC CLAMP CIRCUITS

This invention relates to ordnance fuzes of the radio proximity type. More particularly, it is a feature of this invention to provide improvements in the fuze system, which I will sometimes refer to as the "progression-time" system, described in my copending application, Ser. No. 454,231, filed Sept. 3, 1954, now abandoned.

The progression time system provides ordnance fuzes that respond only to signals that increase in amplitude, at a rate within certain limits, for at least a predetermined time. Signals reflected from a target that the fuze is approaching have the necessary build-up characteristics. It is most unlikely that noise and microphonic signals will have the required build-up characteristics. Furthermore, because the fuze is responsive only to a relatively selective signal, jamming is made correspondingly more difficult.

In general, the progression-time system includes means for obtaining an alternating current signal that increases as the fuze approaches a target; rectifier means for obtaining from this alternating current signal a unipotential signal of increasing amplitude; a differentiator that provides a differentiator output signal only in response to a unipotential signal that increases in amplitude; a limiter that renders high-amplitude noise or jamming signals having very rapid rise rates no more effective than the normally-rising target signal, and an integrator that produces a thyratron-firing voltage only after the differentiator output signal has been at a sufficient level for a sufficient length of time.

Briefly, a principle feature of the present invention is the provision of an improved progression-time fuze having novel features and advantages including a "dynamic clamp" amplifier. A normal target signal, after rectification, provides a rising unipotential signal that is amplified by the dynamic clamp amplifier in normal fashion, to give an amplified unipotential signal that is differentiated and integrated; if the differentiated signal remains at a sufficiently high level sufficiently long, the integrator output builds up to provide a signal that fires a thyratron. But an abnormally large signal reaching the amplifier initiates a clamping action that reduces the signal at the amplifier input, reduces the gain of the amplifier, and gives rise to a ripple signal in the amplifier output. A diode, that serves also to limit the positive-going excursions of the unipotential differentiator output signal, rectifies this ripple signal to develop a negative voltage. This negative voltage is applied to the grid of the thyratron, so that, in the continued presence of a strong jamming signal, the thyratron becomes desensitized.

The present invention thus provides a fuze that is even more immune to noise and jamming than previous progression-time fuzes. Yet the fuze of the present invention is practical and economical to construct, requiring fewer components than certain earlier progression-time fuzes.

A principal object of the invention is to provide a practical, economical, reliable ordnance fuze of the radio proximity type that will be highly resistant to noise and jamming.

Other objects, aspects, uses, and advantages of the invention will become apparent from the accompanying drawing and from the following description.

FIG. 1 is a schematic diagram of a preferred embodiment of an improved progression-time fuze according to the present invention.

Briefly, in FIG. 1 an alternating-current input signal applied to terminal 10 is amplified by amplifier 11, rectified by rectifier 12, differentiated by first differentiator 13, amplified by "dynamic clamp" amplifier 15, differentiated by second differentiator 16, limited by limiter 17, and integrated by intergrator 18. If the input signal at terminal 10 continues to rise at a rate that is neither too high nor too low, the output voltage of integrator 18 builds to the point at which thyratron 71 fires and in turn fires detonator 72.

The frequency response of amplifier 11 is preferably shaped by well known means, response being maximized at the frequency, or over the frequency range, of the desired target signal. It will readily be understood that amplifier 11 provides some limiting action if an unusually large signal is received; on positive peaks of input signal, grid clipping occurs, and on negative peaks the positive excursion of the output signal is limited to the plate supply voltage.

The amplified signal from amplifier 11 is rectified by rectifier 12, which comprises diodes 31 and 32 preferably connected in a voltage-doubling circuit as shown. Resistor 33 is connected across the output of rectifier 12; it is not in general strictly necessary, but its inclusion serves to mask differences between individual diodes.

The output of rectifier 12 is applied to first differentiator 13, which consists of capacitor 36 and resistor 37 in series. The output of differentiator 13 is taken from the junction of capacitor 36 and resistor 37 and applied to grid 38 of "dynamic clamp" amplifier 15. Diodes 31 and 32 are connected to give a negative-going output signal. If this output signal increases rapidly enough, a negative-going signal of increasing amplitude is applied to grid 38.

A positive-going output signal is taken from screen 41 of amplifier 15; screen 41 functions, in effect, as the plate of a class-A triode amplifier. Screen 41 is operated at a higher voltage than plate 42, and in this and other respects the components and supply voltages associated with amplifier 15 are so selected as to cause plate 42 to be nearly saturated for values of negative-going grid 38 signal up to the maximum expected from the desired target signal.

This means that, with a normal target signal driving grid 38 negative, the potential at screen 41 becomes more positive, but the potential at plate 42 changes very little from its initial low value. But if jamming or noise should result in an abnormally large negative signal at grid 38, plate 42 will no longer be saturated; the potential at plate 42 rises when the signal at grid 38 increases above a normal amplitude. With this rise in the potential at plate 42 the potential at point 51 rises, overcoming a negative bias applied to terminal 52, until the potential at point 51 slightly exceeds that at grid 38. Diode 53 now becomes conductive.

When diode 53 starts to conduct, as the result of an abnormally large signal, several important things happen. These phenomena will be described later. First, however, the remainder of the circuit shown in FIG. 1 will be discussed.

The output of amplifier 15, taken from screen 41, is applied to a second differentiator 16 consisting of capacitor 58 and resistor 62. A limiter 17 consisting of diode 61 is connected between the output of differentiator 16 and ground. Limiter 17 limits to ground potential the positive-going excursions of differentiator 16 output, so that an unusually large positive-going output signal from screen 41 does not produce a correspondingly large differentiator output signal. From limiter 17 the signal goes to integrator 18, which consists of resistor 63 and capacitor 66. The output of integrator 18 is applied to grid 68 of thyratron 71. A bias more negative than the firing voltage of grid 68 is applied to terminal 59. Under equilibrium no-signal conditions, the output of differentiator 16, and also the voltage on grid 68, are equal to the bias voltage applied to terminal 59.

It is believed that the above discussion will have made clear the operation of the circuit of FIG. 1 when a normal target signal, having normal buildup characteristics, is received. If the buildup continues for a sufficient time, the output of integrator 18 rises sufficiently to fire thyratron 71.

But, as already indicated, if a negative-going unipotential signal of abnormally large amplitude appears at grid 38, as the result of a suddenly applied jamming signal, the behavior of the circuit is different. As already explained, diode 53 will then become conductive.

When diode 53 is conductive, three important phenomena occur substantially simultaneously. First, resistor 37 becomes shunted by resistor 48, which is preferably of a substantially lower value. Furthermore, it will be understood that resistor 48 is driven by a current component that is out of phase with the current in unshunted resistor 37, and that this current makes the effective shunting resistance still lower. The time constant of first differentiator 13 is thus reduced. This has two valuable effects: the output voltage of differentiator 13 becomes lower than it would otherwise be, and grid 38 is able to recover faster after the jamming signal is removed.

Second, a heavy direct-coupled inverse feedback is applied to grid 38, reducing the gain of amplifier 15.

Because of these first and second phenomena, the unipotential voltages at grid 38 and screen 41 level off substantially at the point at whivh diode 53 begins the clamping action; great increases in the amplitude of a suddenly applied jamming signal cause these voltages to increase only slightly above their clamp-in values.

Third, although the unipotential output at screen 41 levels off substantially with large jamming signals, the ripple-frequency output at screen 41 rises from a negligible to a substantial amplitude. Several factors contribute to this result. First, a larger signal reaching the input of rectifier 12 naturally produces a higher absolute value of ripple voltage in the output of rectifier 12, assuming uniform filtering. Second, although the clamping action reduces the gain of amplifier 15 at the ripple frequency as well as at zero frequency, this reduction in gain is offset at the ripple frequency by a simultaneous reduction in filtering; it will be understood that the filtering of the output of rectifier 12, which filtering is provided by capacitors 56 and 57, decreases when the gain of amplifier 15 decreases. Third, although the clamping action reduces substantially the unipotential output voltage of differentiator 13 by shunting resistor 37 with resistor 48 as already described, the effect on the a-c ripple signal passed through capacitor 36 is negligible if appropriate values of components are selected.

This resulting increased ripple voltage at screen 41 is very important, because it is rectified by limiter diode 61 to develop a negative voltage across capacitor 66 that is applied to grid 68 of thyratron 71. Thus a jamming signal with a high rise rate may result initially in a positive-going unipotential signal at screen 41 that may drive the output of differentiator 16 to ground potential; but before the unipotential differentiator 16 output signal can put enough positive charge into capacitor 66 of integrator 18 to cause firing of thyratron 71, the rectified ripple voltage builds up an opposing negative charge across capacitor 66. If the jamming signal continues, grid 68 may actually become more negative — more removed from the firing potential — than under no-signal equilibrium conditions.

The filtering arrangement shown, with capacitor 57 connected from plate 42 to screen 41, is considered preferable to arrangements in which a capacitor is connected directly from rectifier 12 to screen 41.

It will be understood that the two differentiators, 13 and 16, are not both essential to the operation of the progression-time system; one can be eliminated, although this may entail a slight modification of signal-recognition characteristics and a slight reduction of countermeasures immunity. If only one differentiator is to be retained it should preferably be differentiator 16; differentiation at relatively high signal levels is preferred.

It will be apparent that the embodiment shown is only exemplary and that various modifications can be made in construction and arrangement within the scope of the invention as defined in the appended claims.

I claim:

1. An electronic ordnance fuze adapted to function upon receiving a target signal that increases in amplitude for at least a predetermined length of time, said fuze comprising: input means adapted to receive an alternating-current signal of increasing amplitude; first means for obtaining from said alternating-current signal a first negative-going unipotential signal of increasing amplitude, a ripple frequency due to the original alternating current being superimposed on said unipotential signal; an amplifier tube having at least a control grid, a screen grid, and an anode; means for applying said negative-going unipotential signal to said control grid; sources of direct current supply voltage for said screen grid and said anode, the voltage at the screen grid being maintained more positive than the voltage at the anode and the operating conditions being so maintained that the anode current remains substantially saturated for control grid signals more positive than a predetermined negative value; means for taking an amplified unipotential signal from said screen grid, said screen grid thus resembling functionally the plate of a triode amplifier; first and second capacitor means for coupling said ripple frequency present in said first negative-going unipotential signal to said screen grid and to said anode, said capacitor means tending to filter out said ripple, the degree of filtering being dependent upon the gain of said amplifier tube; means for obtaining a direct-current feedback voltage from said anode; a biased diode; means for applying said feedback voltage to said control grid through said biased diode, so that, if said alternating-current signal is of sufficient amplitude and increases in amplitude at an abnormally large rate, a direct-coupled inverse feedback voltage is applied to said control grid, reducing the gain of said amplifier but permitting the ripple-frequency output of said amplifier to increase; resistance-capacitance differentiator means adapted to produce a unipotential output signal upon receiving a positive-going unipotential signal from said screen grid of said amplifier; diode rectifier-limiter means connected between the output of said differentiator means and ground, said rectifier-limiter means serving to prevent the output of said differentiator means from rising appreciably above ground potential and serving also to rectify any component of said ripple frequency present in the input of said differentiator means, so as to make the output of said differentiator means more negative when the ripple-frequency output of said amplifier increases; resistance-capacitance integrator means connected to the output of said differentiator means; a thyratron; means for applying to the grid of said thyratron a signal from the output of said integrator means; and fixed bias means for maintaining the output of said differentiator and the grid of said thyratron a values sufficiently negative to prevent firing of said thyratron in the absence of a signal.

2. The invention according to claim 1 in which said first negative-going unipotential signal is applied to resistance-capacitance differentiator means interposed between said first means and said control grid of said amplifier tube, a negative-going differentiator output signal of increasing amplitude being applied to said control grid when said first negative-going signal increases at a sufficient rate.

* * * * *